US007980209B2

(12) United States Patent
Koneda et al.

(10) Patent No.: US 7,980,209 B2
(45) Date of Patent: Jul. 19, 2011

(54) ELECTROMAGNETIC VALVE ACTUATOR AND VALVE GUIDE HAVING REDUCED TEMPERATURE SENSITIVITY

(75) Inventors: Philip Thomas Koneda, Englewood, FL (US); Thomas William Megli, Dearborn, MI (US); Yan Wang, Ann Arbor, MI (US); Neal James Corey, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 550 days.

(21) Appl. No.: 12/123,573

(22) Filed: May 20, 2008

(65) Prior Publication Data

US 2009/0288619 A1 Nov. 26, 2009

(51) Int. Cl.
*F01L 9/04* (2006.01)

(52) U.S. Cl. ..... 123/90.11; 29/888.41; 251/129.16; 335/256; 335/262

(58) Field of Classification Search ..... 123/90.11, 123/188.9; 251/299.16; 335/255, 256, 262, 335/270; 29/888.4, 888.41
See application file for complete search history.

(56) References Cited

U.S. PATENT DOCUMENTS

| | | | | | |
|---|---|---|---|---|---|
| 1,784,555 | A | * | 12/1930 | Summers | 123/188.9 |
| 1,972,650 | A | * | 9/1934 | Gassaway et al. | 123/188.9 |
| 2,722,925 | A | * | 11/1955 | McElhinney | 123/90.33 |
| 3,037,494 | A | | 6/1962 | Kirkpatrick et al. | |
| 3,809,046 | A | * | 5/1974 | Kammeraad | 123/188.9 |
| 4,442,998 | A | * | 4/1984 | Ohyama et al. | 251/129.08 |
| 4,465,040 | A | | 8/1984 | Pelizzoni | |
| 4,558,293 | A | * | 12/1985 | Haneda et al. | 335/255 |
| 5,873,337 | A | | 2/1999 | Binford | |
| 5,904,125 | A | | 5/1999 | Enright et al. | |
| 6,116,570 | A | * | 9/2000 | Bulgatz et al. | 251/129.1 |
| 6,125,810 | A | * | 10/2000 | Haselkorn | 123/188.9 |
| 6,279,524 | B1 | * | 8/2001 | Schebitz | 123/90.11 |
| 6,321,700 | B1 | * | 11/2001 | Hein et al. | 123/90.11 |
| 6,371,063 | B2 | | 4/2002 | Oyama et al. | |
| 6,477,994 | B2 | * | 11/2002 | Umemoto et al. | 123/90.11 |
| 6,655,657 | B2 | * | 12/2003 | Bircann | 251/214 |
| 6,675,751 | B1 | * | 1/2004 | Megli et al. | 123/90.12 |
| 6,732,684 | B2 | * | 5/2004 | Onohara et al. | 123/90.11 |
| 6,763,789 | B1 | * | 7/2004 | Liang et al. | 123/90.11 |
| 6,845,300 | B2 | | 1/2005 | Haghgooie et al. | |

(Continued)

FOREIGN PATENT DOCUMENTS

WO 2007093692 A1 8/2007

*Primary Examiner* — Thomas E Denion
*Assistant Examiner* — Daniel A Bernstein
(74) *Attorney, Agent, or Firm* — Julia Voutryas; Brooks Kushman P.C.

(57) ABSTRACT

An internal combustion engine includes an electromagnetic valve actuator having an armature between upper and lower electromagnets with a stem extending through one electromagnet and guided by a bushing with increased clearance about at least a portion of the inner circumference in at least a middle portion of the bushing to reduce oil shear length and associated viscous friction in the actuator. A two-piece intake/exhaust valve guide includes a lower half with a stepped outer diameter cooperating with a counter-bored hole in the cylinder head to provide a positive stop. The upper and lower halves of the valve guide have increased clearance relative to the valve stem around at least a portion of the inner circumference to reduce oil shear length and associated viscous friction. Reducing viscous friction of the actuator and associated valve guide improves system robustness by decreasing the system sensitivity to temperature.

13 Claims, 5 Drawing Sheets

U.S. PATENT DOCUMENTS

| | | | |
|---|---|---|---|
| 6,871,617 | B1 | 3/2005 | Winstead et al. |
| 6,997,433 | B2 | 2/2006 | Koneda et al. |
| 7,124,720 | B2 | 10/2006 | Liang et al. |
| 7,314,026 | B2 | 1/2008 | Koneda et al. |
| 2006/0208842 | A1 | 9/2006 | Maerky et al. |
| 2007/0097589 | A1 | 5/2007 | Maerky |
| 2007/0199526 | A1 * | 8/2007 | Volz ..... 123/90.11 |

* cited by examiner

ELECTROMAGNETIC VALVE ACTUATOR AND VALVE GUIDE HAVING REDUCED TEMPERATURE SENSITIVITY

BACKGROUND

1. Technical Field

The present disclosure relates to electromagnetic valve actuators and engine valve guides for internal combustion engines.

2. Background Art

Significant improvements in engine function can result by replacing conventional camshaft valve actuation with electromagnetic valve actuators that facilitate independent control of each valve decoupled from the crankshaft. This type of actuator, when combined with the engine valve and associated return spring, can be referred to as a "mass oscillator". The oscillatory motion of opening and closing the valve is primarily attributable to storing and releasing spring energy with control provided by upper and lower electromagnets selectively energized by the engine controller. When the valve is fully closed, the actuator spring is compressed and stores energy with the upper electromagnet energized to hold the armature stationary against the spring force. To open the valve, the upper electromagnet holding force is reduced to allow the release of stored spring energy which moves the armature and associate engine valve toward the open position. Friction losses oppose this motion and may prevent the armature from reaching the full-open position. To complete the valve opening event, the lower electromagnet is energized to attract and hold the armature in the fully open position. To reduce friction and wear, lubricating oil is generally supplied to the actuator and/or valve stem during operation. However, the lubricating oil contributes to viscous friction loss, which opposes valve stem motion and increases exponentially with decreasing operating temperature. At extremely low temperatures, the force of the springs in combination with the force of the electromagnet may be insufficient to overcome the viscous friction losses and the valve may not operate as intended.

SUMMARY

A multiple cylinder internal combustion engine includes a valve actuation system with an electromagnetic valve actuator having an armature disposed between upper and lower electromagnets with an armature stem extending only through the lower electromagnet and guided by a one-piece bushing with increased clearance about at least a portion of the inner circumference in at least a middle portion of the bushing to reduce oil shear length and associated viscous friction in the actuator. The armature stem actuates an associated engine valve stem that is guided by a two-piece valve guide including a lower half with a stepped outer diameter that cooperates with a counter-bored hole in the cylinder head to provide both a positive stop and to concentrically locate the valve guide with the armature stem. The upper and lower halves of the engine valve guide also have increased clearance relative to the valve stem around at least a portion of the inner circumference to reduce oil shear length and associated viscous friction. Reducing viscous friction of the actuator and associated valve guide improves system robustness by decreasing the system sensitivity to changes in ambient and operating temperature.

In one embodiment, a single-piece armature stem bushing includes an inner low friction lining material bonded to an outer backing material. The bushing includes upper and lower concentric guide bores of a first diameter with a groove formed by a second, larger diameter in the inner lining material and extending between the upper and lower guide bores. A transverse lubricating hole is formed to intersect the groove and provide pressurized lubricating oil to the armature stem. Another embodiment includes a plurality of axial grooves in the lining material that are circumferentially spaced and extend the length of the bushing.

An embodiment of the two-piece engine valve guide includes a lower guide having a first end with a first outside diameter for extending through a first diameter of the counter-bored hole in the cylinder block, a second counter-bored diameter in the cylinder head holds and locates the lower valve guide in its proper position, with an external flange that seats against the bottom of the counter-bore to provide a positive stop and axially position the lower guide within the cylinder head. The lower guide has a smaller inside diameter toward the first end and a larger inside diameter extending through the opposite end. The smaller diameter provides a close clearance to the engine valve stem to guide and align the engine valve with the armature stem of the actuator. An upper guide has an outside diameter generally matched to the larger diameter of the lower guide and is pressed into the larger diameter of the counter bored hole in the cylinder head to contact the lower guide. The upper guide has a smaller inside diameter at one end and a larger inside diameter at the opposite end to provide increased clearance relative to the valve stem to reduce viscous friction associated with lubricating oil contained therein. When both halves of the engine guide are installed into the cylinder head, the two smaller inside diameters provide support for and align the engine valve. The larger clearance diameter, in the middle region of the engine valve guide, provides space for lubrication oil to be displaced.

A method according to one embodiment of the present disclosure includes forming an armature stem bushing from a generally flat piece of backing material to which a low friction lining material, having a groove formed therein, is bonded, positioning the formed bushing within a lower electromagnet of a valve actuator, and machining upper and lower concentric guide holes in the bushing. The method may include forming the groove in the generally flat piece of material in a coining process where lining material is compacted and displaced to form the groove. Similarly, a transverse lubricating hole may be pierced or punched through the generally flat sheet prior to forming the bushing into a generally cylindrical shape. The method may also include inserting a two-piece engine valve guide into a cylinder head by pressing a lower half of the valve guide having a flange into a corresponding counter-bored hole in the cylinder head until the flange contacts the bottom of the counter-bored hole, pressing an upper half of the valve guide into the counter-bored hole until it contacts the lower half, and finish machining concentric guide holes through the upper and lower halves of the valve guide.

The present disclosure includes embodiments having various advantages. For example, embodiments according to the present disclosure incorporate low-cost, high-volume formed bushing technology to reduce viscous friction without compromising armature support in the valve actuator. Embodiments having an increased clearance in a middle portion of an armature stem bushing and/or engine valve guide decouple the wetted surface area from the bearing support length permitting both low viscous friction and low load reactions from misalignment forces. Reduction in the viscous friction coefficient by about 80% using embodiments according to the present disclosure provides more robust valvetrain operation with reduced temperature sensitivity.

The above advantages and other advantages and features will be readily apparent from the following detailed description of the preferred embodiments when taken in connection with the accompanying drawings.

DETAILED DESCRIPTION OF THE PREFERRED EMBODIMENT(S)

As those of ordinary skill in the art will understand, various features of the present disclosure as illustrated and described with reference to any one of the Figures may be combined with features illustrated in one or more other Figures to produce embodiments of the present disclosure that are not explicitly illustrated or described. The combinations of features illustrated provide representative embodiments for typical applications. However, various combinations and modifications of the features consistent with the teachings of the present disclosure may be desired for particular applications or implementations. The present disclosure relates to an electromagnetically actuated valvetrain for a multiple cylinder internal combustion engine. The representative embodiments used to illustrate and describe the disclosure relate generally to a four-stroke, multi-cylinder port injected internal combustion engine with electromagnetic valve actuation. Of course, the present disclosure is independent of the particular engine/vehicle technology or number of cylinders and may be used in a wide variety of applications with various implementations including spark-ignition, compression-ignition, direct injected and/or port injected engines, for example.

Figure 1:
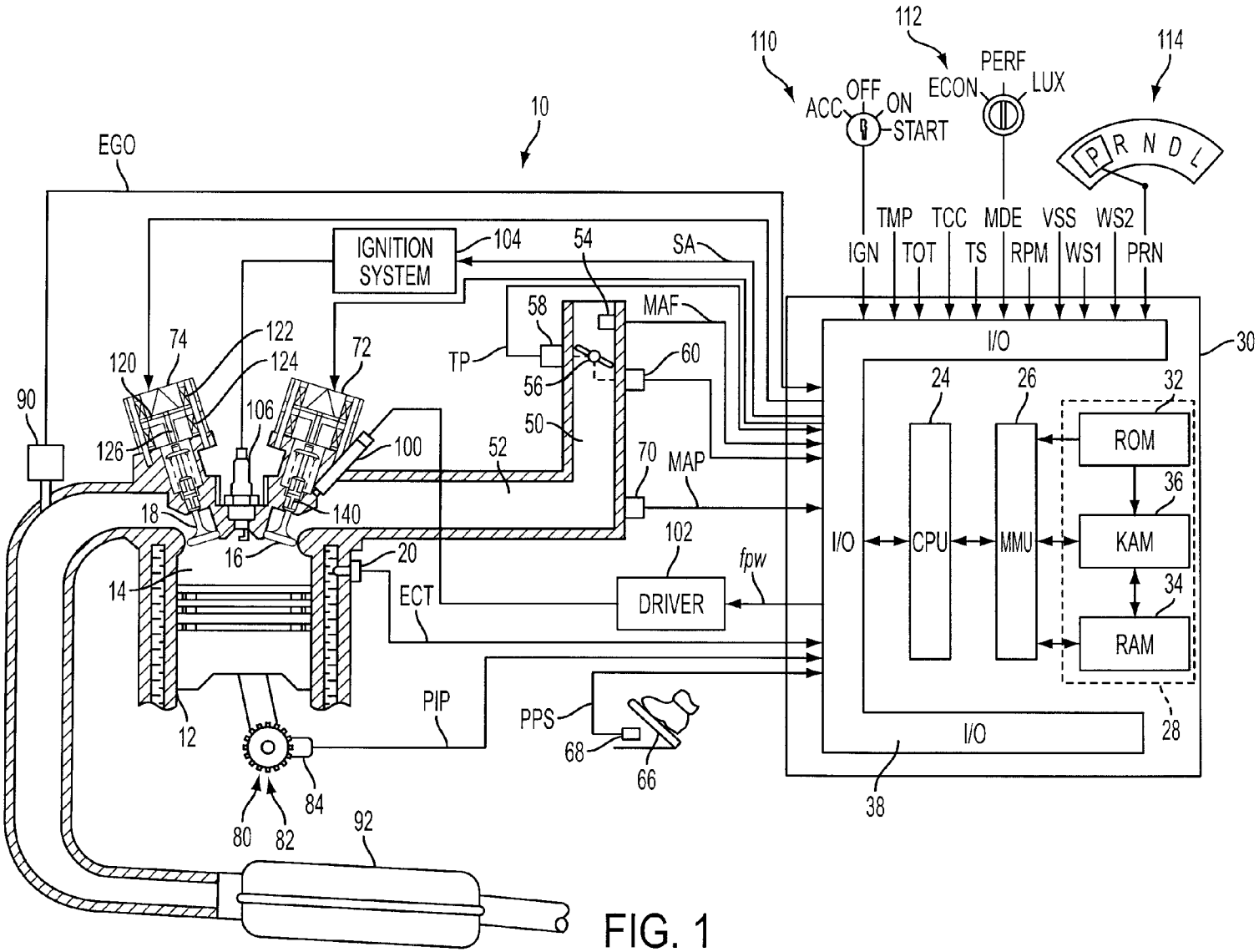
FIG. 1 is a block diagram illustrating operation of system and method for reducing temperature sensitivity of an electromagnetically actuated valvetrain of an internal combustion engine according to one embodiment of the present disclosure.

In the representative embodiment illustrated in FIG. 1, system 10 includes a vehicle (not specifically illustrated) powered by an internal combustion engine having a plurality of cylinders, represented by cylinder 12, with corresponding combustion chambers 14. As one of ordinary skill in the art will appreciate, system 10 includes various sensors and actuators to effect control of the engine/vehicle. One or more sensors or actuators may be provided for each cylinder 12, or a single sensor or actuator may be provided for the engine. For example, each cylinder 12 may include four gas exchange valves including two intake valves 16 and two exhaust valves 18, with only one of each shown in the Figure. However, the engine may include only a single engine coolant temperature sensor 20. In the embodiment illustrated in FIG. 1, the engine includes electromagnetically or electronically actuated intake valves 16 and exhaust valves 18 in communication with a microprocessor-based controller 30 to control valve opening and closing. Other embodiments may include electronically actuated intake valves 16 and conventional exhaust valves 18 actuated by an associated camshaft (not shown), or other combinations of conventionally actuated and electromagnetically actuated valves.

Controller 30 has a microprocessor 24, called a central processing unit (CPU), in communication with memory management unit (MMU) 26. MMU 26 controls the movement of data among the various computer readable storage media 28 and communicates data to and from CPU 24. Computer readable storage media 28 preferably include volatile and non-volatile storage in read-only memory (ROM) 32, random-access memory (RAM) 34, and keep-alive memory (KAM) 36, for example. KAM 36 may be used to store various operating variables while CPU 24 is powered down. Computer-readable storage media 28 may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 24 in controlling the engine or vehicle into which the engine is mounted. Computer-readable storage media 28 may also include floppy disks, CD-ROMs, hard disks, and the like.

CPU 24 communicates with various engine/vehicle sensors and actuators via an input/output (I/O) interface 38. Interface 38 may be implemented as a single integrated interface that provides various raw data or signal conditioning, processing, and/or conversion, short-circuit protection, and the like. Alternatively, one or more dedicated hardware or firmware chips may be used to condition and process particular signals before being supplied to CPU 24. Examples of items that may be directly or indirectly actuated under control of CPU 24, through I/O interface 38, are fuel injection timing, rate, and duration, throttle valve position, spark plug ignition timing (for spark-ignition engines), intake/exhaust valve actuation, timing, and duration, front-end accessory drive (FEAD) components such as an alternator, and the like. Sensors communicating input through I/O interface 38 may be used to indicate crankshaft position (PIP), engine rotational speed (RPM), wheel speed (WS1, WS2), vehicle speed (VSS), coolant temperature (ECT), intake manifold pressure (MAP), accelerator pedal position (PPS), ignition switch position (IGN), throttle valve position (TP), air temperature (TMP), exhaust gas oxygen (EGO) or other exhaust gas component concentration or presence, air flow (MAF), selected and/or current transmission gear or ratio (PRN), transmission oil temperature (TOT), transmission turbine speed (TS), torque converter clutch status (TCC), reduced displacement mode switch (MDE), for example.

Some controller architectures do not contain an MMU 26. If no MMU 26 is employed, CPU 24 manages data and connects directly to ROM 32, RAM 34, and KAM 36. Of course, embodiments of the present disclosure could utilize more than one CPU 24 to provide engine control and controller 30 may contain multiple ROM 32, RAM 34, and KAM 36 coupled to MMU 26 or CPU 30 depending upon the particular application.

In operation, air passes through intake 50 and is distributed to cylinders via an intake manifold, indicated generally by reference numeral 52. System 10 preferably includes a mass airflow sensor 54 that provides a corresponding signal (MAF) to controller 30 indicative of the mass airflow. A throttle valve 56 may be used to modulate the airflow and control pressure in intake 50 to control engine torque. During some regions of engine operation, the electromagnetic valve actuator, in combination with the controller, is fully capable of controlling air flow into the engine cylinder to further improve engine efficiency. Throttle valve 56 is preferably electronically controlled by an appropriate actuator 58 based on a corresponding throttle position (TP) signal generated by controller 30 and the current engine operating mode. The throttle position (TP) signal may be generated in response to a corresponding engine output or torque requested by an operator via accelerator pedal 66. A throttle position sensor 60 provides a feedback signal to controller 30 indicative of the actual position of throttle valve 56 to implement closed loop control of throttle valve 56.

A manifold absolute pressure sensor 70 is used to provide a signal (MAP) indicative of the manifold pressure to controller 30. Air passing through intake manifold 52 enters combustion chamber 14 through appropriate control of one or more intake valves 16. Intake valves 16 and/or exhaust valves 18 may be controlled using electromagnetic actuators 72, 74, a conventional camshaft arrangement, a variable camshaft timing arrangement, or a combination thereof depending on the particular application and implementation.

According to one embodiment of the present disclosure, each electromagnetic actuator 72, 74 includes an armature 120 disposed between an upper electromagnet 122 and a lower electromagnet 124. Armature 120 includes an armature stem 126 that extends through a formed one-piece bushing (best illustrated in FIGS. 2-6) with a groove to provide increased clearance about a middle portion to reduce viscous friction. In this embodiment, armature stem 126 extends through only lower electromagnet 124. Having an armature stem on only one side of the armature and using a one-piece bushing with increased clearance about at least a middle portion of the bushing reduces viscous friction associated with lubricating oil within the actuator as compared to various prior art actuators that include an upper and lower armature stem or shaft thereby reducing operating and ambient temperature sensitivity of the system as described in greater detail with reference to FIGS. 2-8. However, those of ordinary skill in the art will recognize that various other features to reduce viscous friction and corresponding temperature sensitivity as described herein may be incorporated into electromagnetic actuators that include upper and lower armature stems extending through corresponding upper and lower electromagnets.

Electromagnetic actuators 72, 74 respond to control signals from controller 30 to open and close associated intake valves 16 and exhaust valves 18, which include valve stems guided by corresponding two-piece valve guides 140 that have increased clearance about at least a middle portion to reduce viscous friction as, best illustrated and described with reference to FIG. 2.

As also shown in FIG. 1, rotational position information for controlling the engine may be provided by a crankshaft position sensor 80 that includes a toothed wheel 82 and an associated sensor 84. Crankshaft position sensor 80 may be used to generate a signal (PIP) used by controller 30 for fuel injection and ignition timing. Crankshaft position sensor 80 may also be used to determine engine rotational speed and to identify cylinder combustion based on an absolute, relative, or differential engine rotation speed. An exhaust gas oxygen sensor 90 provides a signal (EGO) to controller 30 indicative of whether the exhaust gasses are lean or rich of stoichiometry. Depending upon the particular application, sensor 90 may provide a two-state signal corresponding to a rich or lean condition, or alternatively a signal that is proportional to the stoichiometry of the exhaust gases. The exhaust gas is passed through the exhaust manifold and one or more catalysts 92 before being exhausted to atmosphere. A fuel injector 100 injects an appropriate quantity of fuel in one or more injection events for the current operating mode based on a signal (FPW) generated by controller 30 and processed by driver 102. At the appropriate time during the combustion cycle, controller 30 generates a spark signal (SA) that is processed by ignition system 104 to control spark plug 106 and initiate combustion within chamber 14. Controller 30 may also receive inputs from various vehicle switches, selectors, or other devices such as an ignition switch 110, mode switch 112 and gear or ratio selector 114 depending upon the particular application and implementation.

Figure 2:
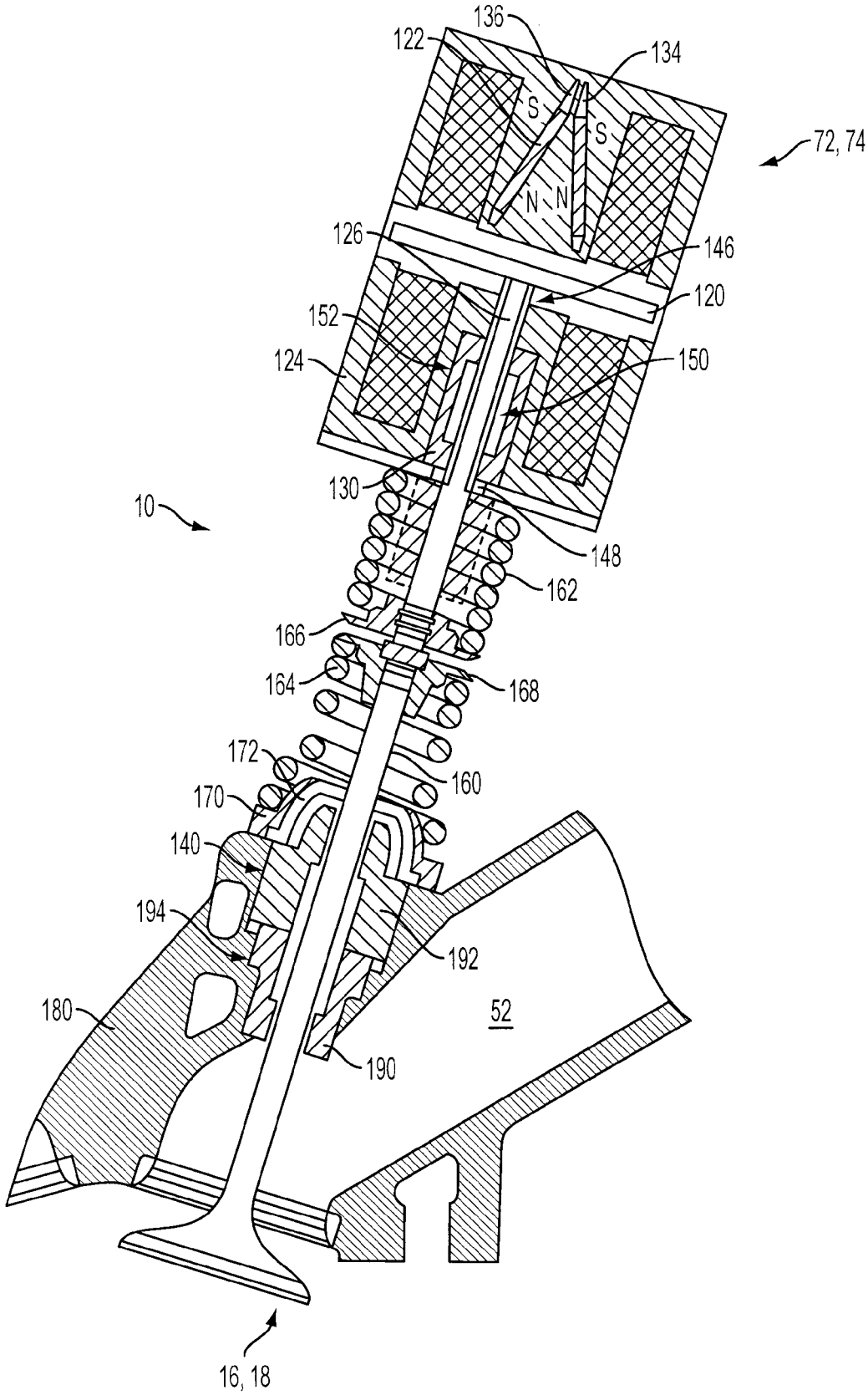
FIG. 2 is a partial cross-section illustrating operation of a valve actuation system or method for a multiple cylinder internal combustion engine according to the present disclosure.

FIG. 2 is a partial cross-section illustrating one embodiment of a valve actuation system or method for a multiple cylinder internal combustion engine with reduced viscous friction and corresponding reduced temperature sensitivity according to the present disclosure. Analysis of the valve actuation system by the present inventors identified various system losses generally classified as being independent of valve velocity and temperature, dependant on valve velocity, and depending on both valve velocity and temperature. The primary source affecting system performance over expected operating and ambient temperatures was determined to be the viscous losses associated with oil film shear over wetted areas between the actuator armature and valve stems and associated bushings. As such, various features of the present disclosure may be used alone or combination to make the system more robust to lubricating oil temperature changes.

In the representative embodiment of a valve actuation system according to the present disclosure illustrated in FIG. 2, electromagnetic valve actuator 72 (74) includes an armature 120 disposed between upper and lower electromagnets 122, 124 with an armature stem 126 extending through at least one electromagnet, which includes the lower electromagnet 124 in this particular embodiment. Actuator 72 (74) also includes at least one single-piece bushing 130 having upper and lower armature stem guide holes 146, 148, respectively, of a first inside diameter to provide a first clearance relative to armature stem 126. Bushing 130 includes at least one groove 150 extending between upper and lower armature guide holes 146, 148. Groove 150 provides a second, larger clearance between bushing 130 and armature stem 126 to reduce viscous friction associated with lubricating oil contained within bushing 130. As described in greater detail with reference to FIGS. 4-6, groove 150 may be implemented as a circumferential groove extending axially between upper and lower guide holes. Alternatively, or in combination, groove 150 may be implemented as one or more axial grooves or slots extending between upper and lower guide holes 146, 148.

Electromagnetic actuator 72 (74) may include an upper electromagnet 122 and/or a lower electromagnet 124 having embedded permanent magnets 134, 136 to enhance system performance as described in detail in commonly owned U.S. Pat. No. 7,124,720. In the representative embodiment of FIG. 2, actuator 72 (74) includes an armature 120 disposed between upper electromagnet 122 and lower electromagnet 124 with a single armature stem 126 that extends only through lower electromagnet 124. A one-piece armature stem bushing 130 is disposed within only one of the electromagnets 122, 124 with the single armature stem 126 passing therethrough. Other embodiments may include actuators having upper and lower armature stems with corresponding one-piece bushings disposed within the upper and lower electromagnets 122, 124, respectively. Bushing 130 includes an upper guide hole 146 and a lower guide hole 148 having a first clearance relative to armature stem 126 and a second, larger clearance relative to armature stem 126 in at least a middle undercut portion 152 of bushing 130. The larger clearance around at least an undercut middle portion 152 of bushing 130 in combination with the smaller clearance of the upper and lower guide holes 146, 148 decouples the wetted bushing area from the corresponding bearing support length to reduce the oil shear length and associated viscous friction of lubricating oil contained within bushing 130 while providing acceptable bushing load reaction forces for any misalignment (tipping or cocking) of armature stem 126.

Armature stem 126 is coupled to a corresponding valve stem 160 of engine valve 16 (18). Upper and lower return springs 162, 164 are secured by corresponding upper and lower spring retainers 166, 168, respectively. An additional retainer 170 functions to secure valve stem seal 172 over the upper end of two-piece valve guide 140, which is pressed within a corresponding counter-bored hole within cylinder head 180. Two-piece valve guide 140 includes a lower half or lower guide 190 in contact with an upper half or upper guide 192. Lower guide 190 includes a stepped outer diameter or flange 194 that cooperates with the counter-bored hole in cylinder head 180 to provide both a positive stop and sufficient interference to form a permanent installation. Upper guide 192 includes one end in contact with a corresponding contacting end of lower guide 190 when installed. Lower and upper valve guides 190, 192 each include a first clearance relative to valve stem 160 at a guiding end and a second, larger clearance relative to valve stem 160 at each opposite contacting end to reduce viscous friction associated with lubricating oil on valve stem 160 as valve 16 (18) opens and closes.

As such, valve guide 140 supports and guides valve stem 160, which is actuated by armature stem 126. Valve guide 140 includes a lower guide 190 having first and second outer diameters cooperating with corresponding first and second inner diameters of the counter-bored hole in cylinder head 180 to provide a positive stop and proper location of valve guide 140 during installation of lower guide 190. Upper guide 192 has one end in contact with a contacting end of lower guide 190 when installed in the counter-bored hole in cylinder head 180. Both lower valve guide 190 and upper valve guide 192 have first and second inside diameters with the second inside diameters being larger than the first inside diameters and extending from the contacting end toward a guiding end to reduce viscous friction associated with movement of valve stem 160 through lubricated guide holes in the guiding ends. Upper valve guide 192 may also include first and second outer diameters with the larger outer diameter at the end contacting the lower valve guide 190 and the smaller outside diameter at the guiding end to accommodate valve stem seal 172 and retainer 170.

Figure 3:
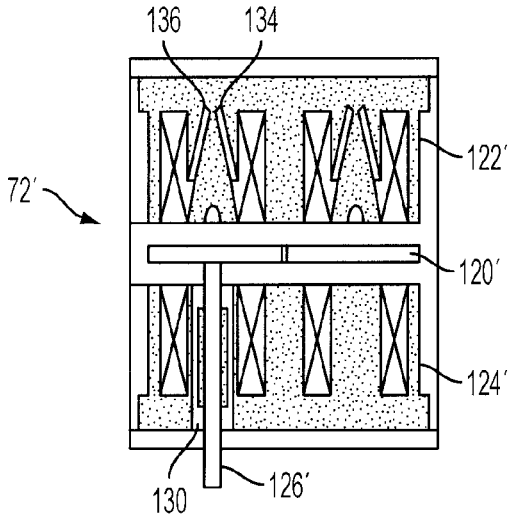
FIG. 3 is a cross-section illustrating one embodiment of an electromagnetic actuator according to the present disclosure.

FIG. 3 is a partial cross-section of an alternative embodiment of an electromagnetic valve actuator according to the present disclosure. Valve actuator 72' is similar in structure and function to valve actuator 72 (74) described with reference to FIGS. 1 and 2 and may include one or more integrated or embedded permanent magnets 134, 136. However, valve actuator 72' includes an extended armature 120' disposed between double wound upper electromagnet 122' and lower electromagnet 124'. Only a single armature stem 126' is associated with armature 120' and extends through only one of the upper and lower electromagnets 122', 124'. Armature stem 126' extends through bushing 130 disposed within lower electromagnet 124' and having increased diametric clearance about a middle portion to reduce viscous friction as previously described.

Figure 4:
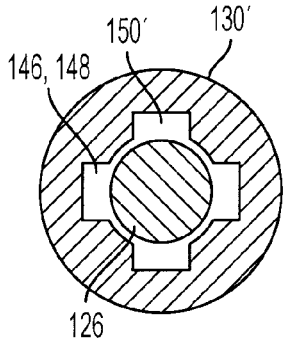
FIG. 4 is a cross-section illustrating one embodiment of an armature bushing or valve guide having axial slots for reducing viscous friction according to present disclosure.

FIG. 4 is a transverse cross-section of one embodiment of an armature stem bushing according to the present disclosure. Those of ordinary skill in the art will understand that a similar cross-section may be used for a one-piece or two-piece valve guide as well. Of course, valve guide applications and actuator applications may have different design constraints and resulting costs, advantages, or disadvantages, for example. Bushing 130' includes a plurality of axial grooves 150' circumferentially spaced and extending the length of the bushing 130'. In an alternative embodiment, axial grooves extend only between upper and lower guide holes 146, 148, respectively. In the representative embodiment illustrated, four axial grooves are provided and are equally spaced around the inner circumference of bushing 130'. Increased clearance provided by axial slots or grooves 150' relative to armature stem 126 reduces viscous friction associated with lubricating oil within bushing 150' during operation, particularly at lower ambient/operating temperatures.

Figure 5:
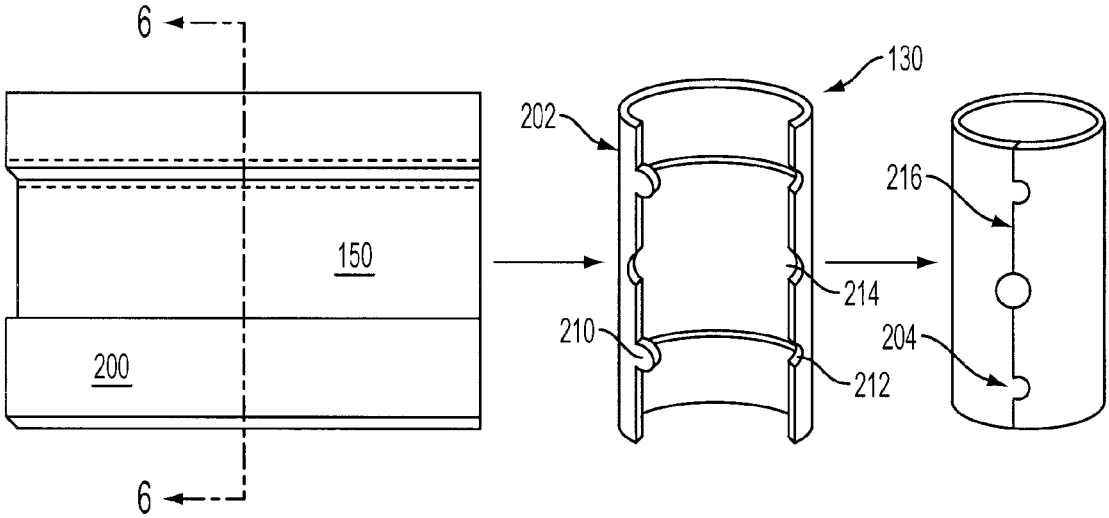
FIG. 5 illustrates one embodiment of an armature stem bushing or valve guide formed from flat stock with a groove and intersecting lubrication hole according to the present disclosure.
Figure 6:
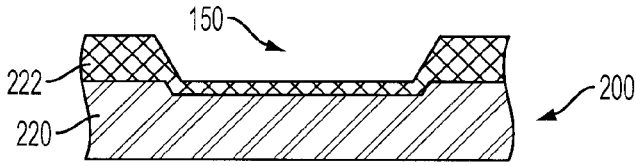
FIG. 6 is a cross-section illustrating a coined groove formed in low-friction lining material bonded to a backing material prior to forming into an armature stem bushing according to one embodiment of the present disclosure.

FIGS. 5 and 6 illustrate a one-piece formed bushing having a formed groove according to one embodiment of the present disclosure. Bushing 130 is formed from a flat piece or sheet 200 of bushing material. Groove 150 is formed in flat piece 200 prior to forming into a generally cylindrical bushing having an axial seam 216. At least one seam lock 202, 204 may be provided to maintain a closed seam. In the representative embodiment illustrated, each seam lock 202, 204 includes a protrusion 210 with a complementary recess or notch 212 in the opposite edge of the flat material that are interlocked during forming to lock axial seam 216. Alternatively, the seam may be left slightly open such that insertion of the bushing within a corresponding hole closes and secures the seam. A transverse lubricating hole 214 may be formed through flat piece 200 that intersects groove 150 to provide lubricating oil to the interior of the bushing 130 during engine operation. Lubricating hole 214 may be formed along seam 216 as illustrated, or may be formed or punched through a middle portion of groove 150.

One-piece bushing 130 may be formed from a flat sheet or piece 200 that includes a backing material 220 to which a lining material 222 is bonded using a furnace sintering operation, for example. Use of a low-friction lining material 222 bonded to a backing material 220 allows selection of a desired lining material to improve actuator performance while backing material 220 provides structural support during installation and any in-place finish machining. Groove 150 may be formed using a coining process, which compacts and displaces lining material 222 and may also compact backing material 220 as shown. Use of formed bushing technology to provide a one-piece armature bushing having increased diametric clearance in a middle portion of the bushing for an electromagnetic valve actuator according to the present disclosure provides a low-cost, high-volume solution that improves actuator performance by reducing viscous friction during cold temperature operation without compromising armature stem support. The increased clearance in the center of bushing 130 provided by groove 150 reduces the oil shear length of lubricating oil contained within the bushing during operation.

Figure 7:
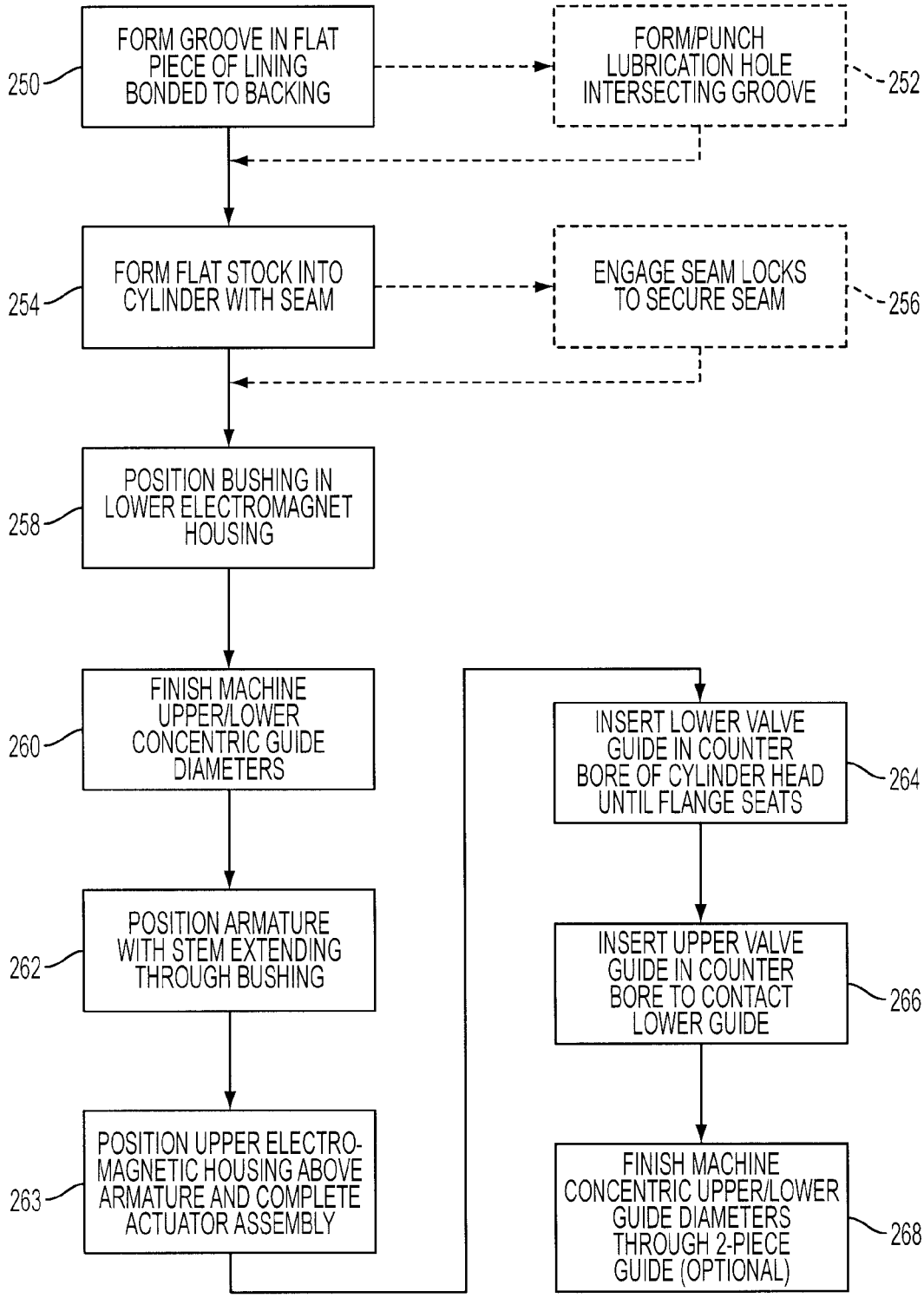
FIG. 7 is a flow diagram illustrating one embodiment of a method for reducing temperature sensitivity for a valve actuation system according to the present disclosure.

FIG. 7 is a flow diagram illustrating a method for reducing temperature sensitivity of a valve actuation system according to embodiments of the present disclosure. Those of ordinary skill in the art will understand that various processes or steps illustrated may be performed in a different order, may be repeated, or may be omitted while still achieving reduced temperature sensitivity according to the present disclosure. As represented by block 250, a groove is formed in a generally flat piece of bushing material, which may include a low-friction lining material bonded to a structural backing material. The groove provides increased clearance relative to an armature stem through at least a middle section of the bushing after forming as previously illustrated and described. The process may optionally include forming, piercing, or punching a lubrication hole that intersects the groove as represented by block 252. The generally flat piece of bushing material or stock with a groove formed therein is then formed into a cylinder with an axial seam as represented by block 254. Depending on the particular application and implementation, one or more seam locks may be formed in the flat piece of bushing stock along the ends of the stock that meet to form the cylinder with an axial seam. Seam locks may be formed from complementary shaped projections and cut-outs of the stock that engage one another to secure the seam as represented by block 256.

As also shown in FIG. 7, after the flat bushing stock is formed into a cylinder, the one-piece bushing is inserted into at least one electromagnet of the actuator. In one embodiment, the bushing is inserted into a lower electromagnet as represented by block 258. The upper and lower concentric guide diameters of the bushing are then finish machined to provide a desired oil-film clearance for the armature stem as represented by block 260. The armature is positioned with the armature stem extending through the upper and lower guide holes in the bushing as represented by block 262 during final assembly of the valve actuator. The upper electromagnet housing is then positioned above the armature to complete the actuator assembly as represented by block 263.

The method may also include positioning a two-piece valve guide in a cylinder head of the engine as represented by steps 264, 266, and 268. A lower valve guide half having a stepped outside diameter forming a shoulder or flange is pressed into a corresponding counter-bored hole in the cylinder head until its shoulder seats against the shoulder or bottom of the larger diameter of the counter-bored hole as represented by block 264. An upper valve guide half is then inserted into the counter-bored hole until it contacts the lower valve guide half as represented by block 266. Concentric upper and lower guide diameters may optionally be finish machined through the upper and lower guides as represented by block 268. In some engine applications, the valve guides can be installed with the valve steam clearance diameter finish machined to eliminate the finish machining in-place as represented by block 268. An intake or exhaust valve is then positioned with its valve stem extending through the upper and lower guide holes of the two-piece valve guide for actuation by the armature stem. As previously described, the upper and lower valve guide halves each have a larger clearance relative to the valve stem at one end relative to an opposite end to reduce viscous friction associated with lubricating oil within the valve guides.

Figure 8:
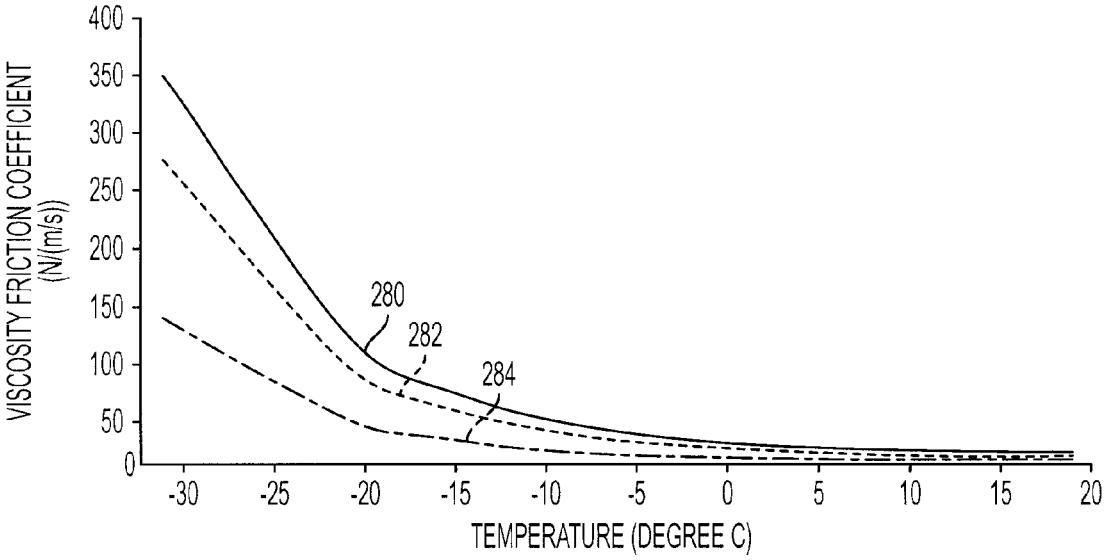
FIG. 8 illustrates reduced viscous friction associated with a valve actuation system according to one embodiment of the present disclosure.

FIG. 8 is a graph that illustrates the reduction of viscous friction coefficient associated with representative embodiments of an electromagnetic valve actuation system according to the present disclosure. Line 280 represents the viscous friction coefficient as a function of temperature for a representative prior art system having an actuator with upper and lower armature stems guided by conventional armature stem and engine valve guide bushings. Elimination of the upper armature stem while using a conventional bushing for the lower armature stem reduces the viscous friction coefficient as represented by line 282. Use of a bushing according to the present disclosure having increased clearance about at least a middle portion of the bushing in an actuator having only a single armature stem resulted in a viscous friction coefficient as represented by line 284.

As illustrated and described with reference to the various embodiments, the present disclosure provides a system and method for reducing temperature sensitivity in an electromagnetically actuated valvetrain of an internal combustion engine. Embodiments of the disclosure incorporate low-cost, high-volume formed bushing technology to reduce viscous friction without compromising armature support in the valve actuator. Providing an increased clearance in a middle portion of an armature stem bushing and/or valve guide decouples wetted surface area from the bearing support length permitting both low viscous friction and low load reactions from misalignment forces. Reduction in the viscous friction coefficient by about 80% using embodiments according to the present disclosure provides more robust valvetrain operation with reduced temperature sensitivity.

While the best mode has been described in detail, those familiar with the art will recognize various alternative designs and embodiments within the scope of the following claims. Several embodiments have been compared and contrasted. Some embodiments have been described as providing advantages or being preferred over other embodiments in regard to one or more desired characteristics. However, as one skilled in the art is aware, one or more characteristics may be compromised to achieve desired system attributes, which depend on the specific application. These attributes include, but are not limited to: cost, strength, durability, life cycle cost, marketability, appearance, packaging, size, serviceability, weight, manufacturability, ease of assembly, etc. The embodiments discussed herein that are described as inferior to another embodiment with respect to one or more characteristics are not outside the scope of the disclosure.

What is claimed:

1. A valve actuation system for a multiple cylinder internal combustion engine, the system comprising:

an electromagnetic valve actuator having an armature disposed between upper and lower electromagnets with an armature stem extending through only the lower electromagnet;

a bushing disposed within the lower electromagnet with the armature stem passing therethrough, the bushing having a first clearance relative to the armature stem near at least each end of the bushing and a second, larger clearance relative to the armature stem in at least a middle portion of the bushing; and a valve guide for guiding an engine valve stem actuated by the armature stem, the valve guide having a lower guide with a stepped outer diameter that cooperates with a counter-bored hole in a cylinder head to provide a positive stop during installation, and an upper guide having one end in contact with a contacting end of the lower guide, the upper and lower guides each having a first clearance relative to the valve stem at one end, and a second, larger clearance relative to the valve stem at each contacting end.

2. The system of claim 1 wherein the bushing includes a middle portion having an interior circumferential groove to provide the second, larger clearance.

3. The system of claim 1 wherein the bushing includes a plurality of axial grooves circumferentially spaced and extending the length of the bushing.

4. The system of claim 1 wherein the bushing comprises a single-piece bushing.

5. The system of claim 1 wherein the bushing comprises:

an outer backing material; and an inner low friction lining material bonded to the outer backing material.

6. The system of claim 1 wherein the bushing includes an axial seam.

7. The system of claim 6 wherein the bushing includes at least one seam lock.

8. The system of claim 1 wherein the bushing includes a transverse lubricating hole intersecting the second, larger clearance area of the bushing.

9. A valve actuation system for a multiple cylinder internal combustion engine, the system comprising:

an electromagnetic valve actuator having an armature disposed between upper and lower electromagnets with an armature stem extending through at least one electromagnet;

at least one single-piece bushing having upper and lower armature guide holes of a first inside diameter and a groove having a second, larger inside diameter and extending between the upper and lower guide holes, the bushing disposed in at least one of the electromagnets with the armature stem extending therethrough; and a valve guide for guiding an engine valve stem actuated by the armature stem, the valve guide having a lower guide with first and second outer diameters cooperating with corresponding first and second diameters of a counter-bored hole in a cylinder head to provide a positive stop during installation of the lower guide, and an upper guide having one end in contact with a contacting end of the lower guide when installed in the counter-bored hole of the cylinder head, the upper and lower guides each having first and second inside diameters with the second inside diameters being larger than the first inside diameters and extending from the contacting end toward a guiding end.

10. The system of claim 9 wherein the at least one single-piece bushing comprises:

an outer steel backing material; and an inner low friction lining material bonded to the outer steel backing material.

11. The system of claim 9 wherein the at least one single-piece bushing includes an axial seam.

12. The system of claim 9 wherein the at least one single-piece bushing includes a plurality of internal axial slots extending between the upper and lower guide holes.

13. The system of claim 9 wherein the upper guide includes first and second outer diameters.

* * * * *